US011180312B2

(12) United States Patent
Tuttle

(10) Patent No.: US 11,180,312 B2
(45) Date of Patent: Nov. 23, 2021

(54) BEVERAGE CARTRIDGE

(71) Applicant: Michael Tuttle, Anchorage, AK (US)

(72) Inventor: Michael Tuttle, Anchorage, AK (US)

( * ) Notice: Subject to any disclaimer, the term of this patent is extended or adjusted under 35 U.S.C. 154(b) by 366 days.

(21) Appl. No.: 16/364,118

(22) Filed: Mar. 25, 2019

(65) Prior Publication Data

US 2019/0291946 A1 Sep. 26, 2019

Related U.S. Application Data

(60) Provisional application No. 62/648,168, filed on Mar. 26, 2018.

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

2013/0164414 A1* 6/2013 Hermanowski .... B65D 85/8043 426/81
2014/0370181 A1* 12/2014 Young ..... A23F 5/12 426/595
2015/0064311 A1* 3/2015 Fu ..... B01D 39/16 426/80
2017/0055757 A1* 3/2017 Fu ..... A47J 31/06
2017/0305653 A1* 10/2017 Norton ..... B65D 85/8043
2019/0291946 A1* 9/2019 Tuttle ..... B65D 85/8043
2021/0070537 A1* 3/2021 Bunner ..... B65D 1/46

* cited by examiner

*Primary Examiner* — Omar Flores Sanchez
(74) *Attorney, Agent, or Firm* — Marshall, Gerstein & Borun LLP

(57) ABSTRACT

Beverage cartridges, and methods of assembly, are disclosed that include a housing, a filter extending across an interior of the housing dividing the housing into an upper portion and a lower portion, a beverage ingredient disposed within the upper portion of the housing, and a supplement ingredient disposed within the lower portion of the housing. With this configuration, beverage cartridges as provided herein can be used to prepare a mixed beverage containing the beverage ingredient as well as the supplement ingredient.

18 Claims, 3 Drawing Sheets

BEVERAGE CARTRIDGE

CROSS-REFERENCE TO RELATED APPLICATION

The present application claims priority to U.S. Provisional Application No. 62/648,168, filed Mar. 26, 2018, which is hereby incorporated by reference herein in its entirety.

FIELD OF THE DISCLOSURE

The present disclosure generally relates to beverage cartridges and, more particularly, beverage cartridges for use with beverage machines.

BACKGROUND

A current trend in some circles is to add butter to coffee, stating that the combination results in a variety of benefits. This procedure, however, can add additional steps to the beverage-making process and utilize additional dishes or appliances. In one example, a user brews the coffee and subsequently pours the coffee into a blender along with a desired amount of butter and other optional ingredients to mix the ingredients together. As can be understood, the additional time and effort required of such steps may deter people from partaking in the combination.

In another example, one method for making coffee or other brewed beverages utilizes cartridges and a brewing machine. The brewing machine is configured to receive the cartridge therein, pierce the cartridge, and send hot water through the cartridge to a dispensing opening to thereby create individual portions of brewed coffee. While convenient, if a user would like to add butter to the brewed coffee, the user is still faced with the additional step(s) discussed above with conventionally brewed coffee.

SUMMARY

In accordance with a first exemplary aspect, a cartridge for preparing a beverage is disclosed that includes a housing having an interior defined by a sidewall and bottom wall, and an open top. The beverage cartridge further includes a filter that extends across the interior of the housing dividing the housing into an upper portion and a lower portion. A beverage ingredient is disposed within the upper portion of the housing between the filter and the open top and a supplement ingredient is disposed within the lower portion of the housing. The beverage cartridge further includes a cover secured to the housing so to extend over the open top to seal the interior.

In accordance with one preferred form, the beverage cartridge further includes a generally rigid basket, where the filter is secured to the basket such that the basket imparts a cup-shaped form to the filter. In accordance with a further form, the sidewall of the housing can include an inwardly projecting shoulder and the basket can include an outwardly projecting flange that is configured so that, with the basket received within the housing interior, the flange rests on the inwardly projecting shoulder.

In accordance with one preferred form, the beverage ingredient can be ground coffee.

In accordance with one preferred form, the supplement ingredient can be configured to melt or dissolve in hot water. In accordance with a further form, the supplement ingredient can be clarified butter. In other forms, the supplement ingredient can be one or more of: butter, coconut oil, avocado oil, medium chain triglyceride (MCT) oil, tetrahydrocannabinol (THC), cannabidiol (CBD), sugar, spices, or herbs.

In accordance with a second exemplary aspect, the beverage cartridge configured in any of the above forms can be in combination with a beverage machine. The beverage machine can include a top utensil that is configured to puncture the cover of the beverage cartridge and deliver hot water to the interior of the housing and a bottom utensil that is configured to puncture the bottom wall of the housing. With such a configuration, the hot water can intermix with the beverage ingredient and the supplement ingredient and drain through the bottom wall of the housing.

In accordance with a third exemplary aspect, a method of preparing a supplemented brewed beverage using a beverage cartridge is disclosed that includes discharging hot water into the beverage cartridge, intermixing the hot water with a beverage ingredient contained within the cartridge to create a brewed beverage, filtering the brewed beverage with a filter extending across an interior of the beverage cartridge to create a filtered brewed beverage, and intermixing the filtered brewed beverage with a supplement ingredient disposed in a lower portion of the beverage cartridge spaced from the filter to create a supplemented brewed beverage.

In accordance with one preferred form, the method can further include dispensing the supplemented brewed beverage through an opening in a bottom wall of the beverage cartridge.

In accordance with one preferred form, the method can further include puncturing a cover of the beverage cartridge with a hollow utensil and discharging the hot water into the beverage cartridge can include discharging the hot water through the hollow utensil.

In accordance with one preferred form, intermixing the hot water with a beverage ingredient can include intermixing the hot water with ground coffee.

In accordance with one preferred form, intermixing the filtered brewed beverage with the supplement ingredient can include melting the supplement ingredient with the filtered brewed beverage.

In accordance with one preferred form, intermixing the filtered brewed beverage with the supplement ingredient can include intermixing the filtered brewed beverage with clarified butter. In other forms, intermixing the filtered brewed beverage with the supplement ingredient can include intermixing the filtered brewed beverage with one or more of: butter, coconut oil, avocado oil, medium chain triglyceride (MCT) oil, tetrahydrocannabinol (THC), cannabidiol (CBD), sugar, spices, or herbs.

In accordance with a fourth exemplary aspect, a method of assembling a beverage cartridge is disclosed that includes depositing a supplement ingredient in a lower portion of a housing of the beverage cartridge, disposing a filter assembly into the interior of the housing, depositing a predetermined amount of beverage ingredient into the filter assembly, and sealing an open top of the housing with a cover.

In accordance with one preferred form, depositing the supplement ingredient in the lower portion of the housing can include depositing one or more of: clarified butter, butter, coconut oil, avocado oil, medium chain triglyceride (MCT) oil, tetrahydrocannabinol (THC), cannabidiol (CBD), sugar, spices, or herbs, in the lower portion of the housing.

In accordance with one preferred form, depositing the predetermined amount of beverage ingredient into the filter assembly can include depositing a predetermined amount of ground coffee into the filter assembly.

In accordance with one preferred form, disposing the filter assembly into the interior of the housing can include inserting the filter assembly into the interior of the housing until an outwardly projecting flange of the filter assembly abuts an inwardly projecting shoulder of a sidewall of the housing. The filter assembly can be sized so that with the flange abutting the shoulder, the lower portion of the housing corresponds to an open lower portion extending between a bottom surface of the filter assembly and a bottom wall of the housing.

BRIEF DESCRIPTION OF THE DRAWINGS

The above needs are at least partially met through provision of the embodiments described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Beverage cartridges and methods are disclosed that conveniently combine a brewed beverage with a supplement ingredient. By utilizing a beverage cartridge as described herein, a user is provided with a mixed beverage containing the brewed product as well as the supplement ingredient without secondary mixing steps or using extraneous appliances.

Figure 1:
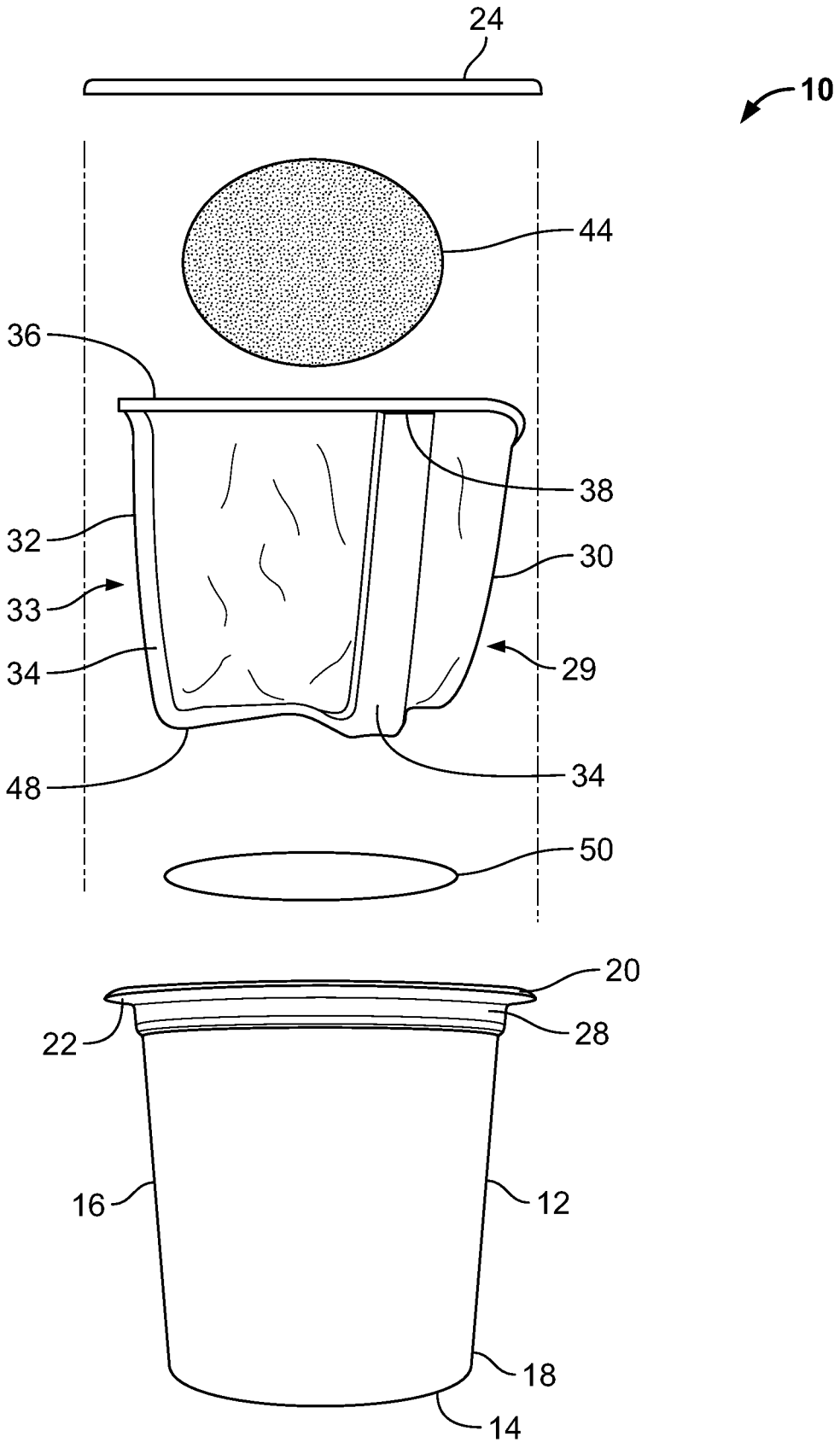
FIG. 1 is an exploded view of a beverage cartridge in accordance with various embodiments of the present disclosure.

An exemplary beverage cartridge 10 is shown in exploded view in FIG. 1. The cartridge 10 has a cup-shaped housing 12 with a bottom wall 14, an upstanding sidewall 16 extending upwardly from edges 18 of the bottom wall 14, and a flange 20 projecting outwardly from an upper edge 22 of the sidewall 16. A cover 24, which can be foil, plastic, combinations thereof, and so forth, can be adhered or otherwise secured to the flange 20 to create a sealed interior 26 of the housing 12.

As shown, the sidewall 16 includes an inwardly projecting shoulder 28 extending therearound. In the illustrated form, the sidewall 16 has a cylindrical configuration and the shoulder 28 has an annular configuration that extends up and around the circumference of the sidewall 16. Further, the sidewall 16 tapers outwardly as it extends from the bottom wall 14 so that the sidewall 16 has a frusto-conical shape. It will be understood that the housing 12 can have other suitable shapes and configurations for any given cartridge-based beverage device.

As shown in FIG. 1, the cartridge 10 further includes a filter assembly 29 having a filter 30 and a basket 32. The filter 30 can have a shape generally complementary to the cup shape of the housing 12 or can be folded to fit within the interior 26 of the housing 12. In the illustrated form, the filter 30 has a circular, planar shape. The basket 32 can include a porous lower portion 33 defined a plurality of ribs 34, such as four as shown, joining to form a cup shape and a flange 36 extending around and projecting outwardly from upper edges 38 of the ribs 34. In order to hold a desired shape, a perimeter 40 (shown in FIG. 2) of the filter 30 can be adhered or otherwise secured to the basket flange 36 and an interior portion 42 of the filter 30 projects downwardly into the porous lower portion 33 defined by the ribs 34. With many filter shapes, the filter 30 can be folded or otherwise crumpled to generally conform to the shape of the basket 32.

Figure 2:
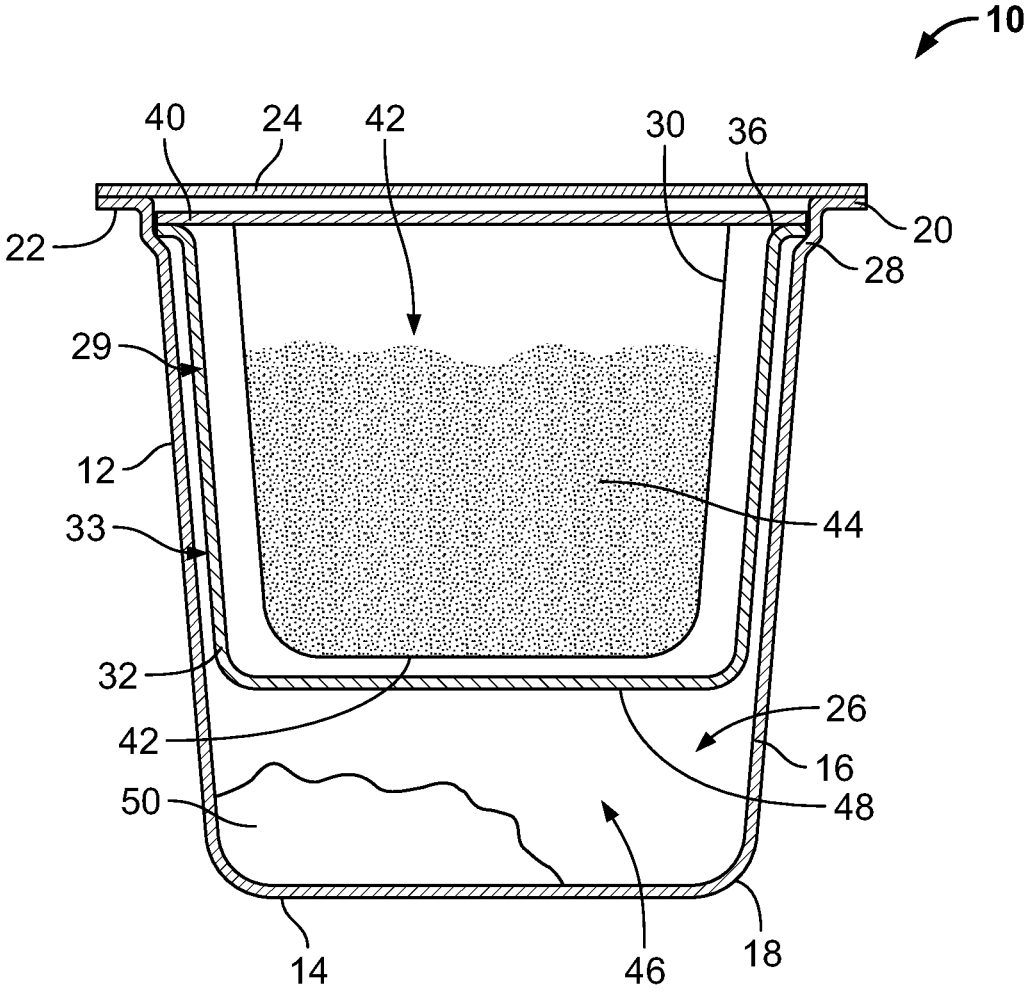
FIG. 2 is a cross-sectional view of a beverage cartridge in accordance with various embodiments of the present disclosure.

The flange 36 preferably has a shape generally complementary to a horizontal cross-section of the housing 12, but with an interior edge portion sized slightly smaller than the housing 12, so that the basket 32 can fit within the housing interior 26, as shown in FIG. 2. In the illustrated form, the flange 36 has an annular configuration with an outer diameter sized larger than a diameter of the sidewall 16 below the shoulder 28 so that the flange 36 can rest on the shoulder 28 of the housing 12. So configured, a beverage ingredient 44, such as ground roast coffee, instant coffee, cocoa, tea, combinations thereof, and so forth, can be disposed within the cup-shape of the filter 26 and stored within the housing 12. In alternative forms, the filter 30 can be adhered or otherwise secured to the shoulder 28 without using the basket 32.

Further, as shown in FIG. 2, the filter assembly 29 is sized to have a height less than a height of the housing 12 between the bottom wall 14 and the shoulder 28 so with the filter assembly 29 fully received within the housing 12, there is an open lower portion 46 of the interior 26 between a lower surface 48 of the basket 32 and the bottom wall 14. Advantageously, the cartridge 10 disclosed herein utilizes this lower portion 46 to enclose a supplement ingredient 50. In some versions, the beverage ingredient 44 and the supplement ingredient 50 can be shelf-stable so that the cartridge 10 can be stored, transported, and displayed for sale at room temperature for an extended period. In alternative versions, the supplemental ingredient 50 can be disposed within the filter 30 along with the beverage ingredient 44. In these versions, the filter assembly 29 can extend along most or all of the height of the housing 12.

The supplement ingredient 50 can preferably melt, dissolve, or otherwise liquidize when introduced to water, hot or otherwise, or other desired liquid flowing through the cartridge 10. As such, the supplement ingredient 50 is mixed with the beverage as it passes through the cartridge 10 to create a supplemented beverage. In one form, the supplement ingredient can be clarified butter, such as ghee, to add healthy fat soluble vitamins, conjugated linoleic acid, butyrate, and other beneficial ingredients, and optionally a cosmetic sheen to the supplemented beverage. In other embodiments, the supplemental ingredient 50 can include other ingredients instead of or in addition to clarified butter including, for example, any high fat solution or fatty oil, conventional butter, coconut oil, avocado oil, medium chain triglyceride (MCT) oil, or any other fat, natural and/or artificial flavoring, sugar, spices, and/or herbs. In some versions, the supplement ingredient 50 may have medicinal qualities by being infused with traditional Chinese herbal remedies, tetrahydrocannabinol (THC), related hemp or cannabis compounds including, e.g., cannabidiol (CBD), etc.

Figure 3:
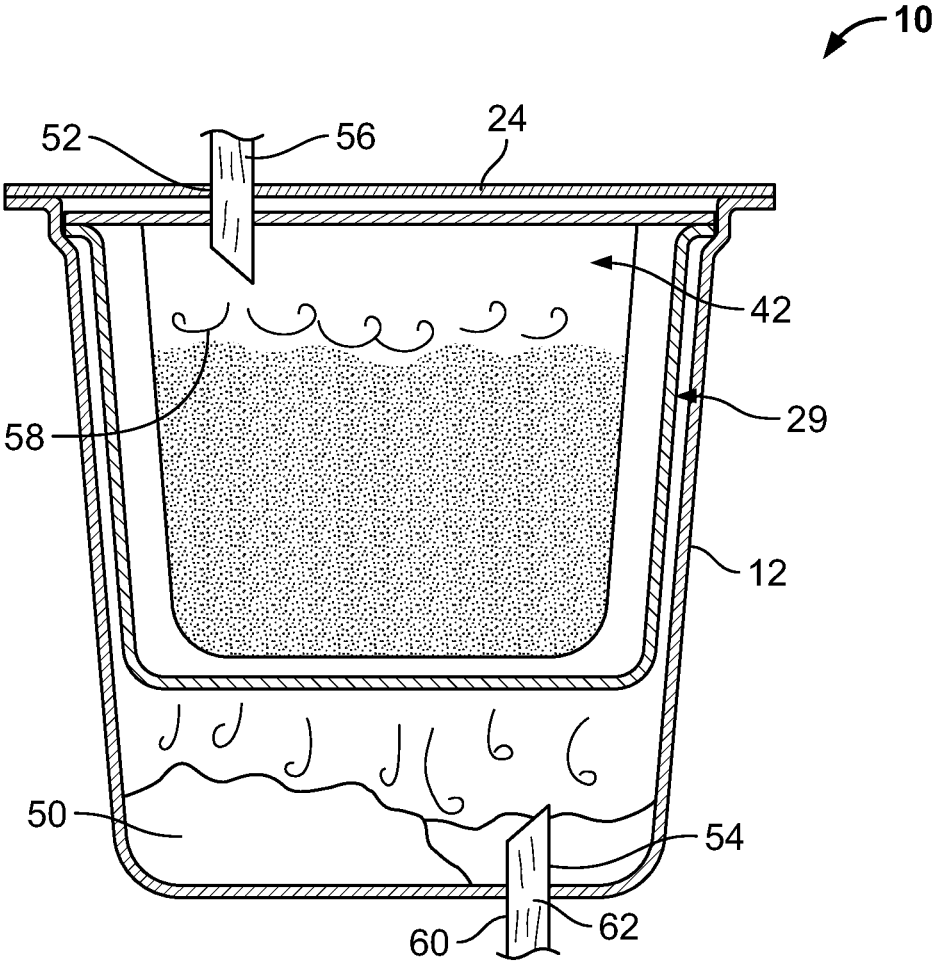
FIG. 3 is a cross-sectional view of the beverage cartridge of FIG. 2 showing a brewing process in accordance with various embodiments of the present disclosure.

As shown in FIG. 3, during use, a suitable beverage machine pierces the cover 24 and the bottom wall 14 to create openings 52, 54 therethrough. If desired, the brewing machine can leave a hollow top piercing utensil 56 within the cartridge 10 to deliver hot water 58 or any other suitable liquid to the housing interior 26 therethrough. Further, the beverage machine can leave a hollow bottom piercing utensil 60 within the housing interior 26 to act as a drain for a brewed beverage 62. Alternatively, the bottom piercing utensil 60 can be withdrawn so that the brewed beverage can drain through the opening 54 extending through the bottom wall 14.

As discussed above, the supplement ingredient 50 can be melted by the hot water 58 and/or be soluble in the hot water 58. So configured, the hot water 58 is dispensed above the beverage ingredient 44 to filter therethrough and seep through the filter 30 into the lower portion 46 of the housing 12. The hot water 58 then melts and/or dissolves the supplement ingredient 50 so that the resulting supplemented brewed beverage 62 is a mixture of the beverage ingredient 44 and the supplement ingredient 50.

In a preferred form, the beverage ingredient 44 is ground roast coffee or instant coffee and the supplement ingredient 50 is clarified butter, such as ghee. This cartridge 10 will provide a user with brewed coffee that is automatically mixed with clarified butter, saving the user from secondary steps, such as mixing butter into the coffee or cleaning secondary appliances. The coffee in a preferred version includes approximately 1 to 3 Tablespoons of ground roasted coffee, and more specifically approximately 2 to 3 Tablespoons. The supplement ingredient 50 can be in any desired amount corresponding to the type of ingredient and desired mixture within the final amount. In one form, the supplement ingredient 50 can be disposed in the beverage cartridge 10 in a range of about ⅛ teaspoon to about 2 teaspoons per serving of beverage, preferably between about 3/16 teaspoon to about 1 teaspoon per serving of beverage, and more preferably between about ¼ teaspoon to about ½ teaspoon per serving of beverage. In one example, the beverage cartridge 10 can be configured to provide a single serving of beverage, such as brewed coffee, and the supplement ingredient can be about ¼ teaspoon of clarified butter.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A cartridge for preparing a beverage, the beverage cartridge comprising:

a housing having an interior defined by a sidewall and bottom wall, and an open top;

a filter extending across the interior of the housing dividing the housing into an upper portion and a lower portion;

a generally rigid basket with an outwardly projecting flange, the filter secured to the basket such that the basket imparts a cup-shaped form to the filter;

a beverage ingredient disposed within the upper portion of the housing between the filter and the open top;

a supplement ingredient disposed within the lower portion of the housing; and a cover secured to the housing extending over the open top to seal the interiors;

wherein the sidewall of the housing includes an inwardly projecting shoulder, the outwardly projecting flange of the basket being configured so that, with the basket received within the interior of the housing, the outwardly projecting flange rests on the inwardly projecting shoulder.

2. The beverage cartridge of claim 1, wherein the filter comprises a circular filter with a peripheral edge secured to the flange of the basket.

3. The beverage cartridge of claim 1, wherein the beverage ingredient comprises ground coffee.

4. The beverage cartridge of claim 1, wherein the supplement ingredient is configured to melt or dissolve in hot water.

5. The beverage cartridge of claim 4, wherein the supplement ingredient comprises clarified butter.

6. The beverage cartridge of claim 1, wherein the supplement ingredient consists of one or more of: butter, coconut oil, avocado oil, medium chain triglyceride (MCT) oil, tetrahydrocannabinol (THC), cannabidiol (CBD), sugar, spices, or herbs.

7. The beverage cartridge of claim 1 in combination with a beverage machine, the beverage machine comprising:

a top utensil configured to puncture the cover of the beverage cartridge and deliver hot water to the interior of the housing; and a bottom utensil configured to puncture the bottom wall of the housing, such that the hot water can intermix with the beverage ingredient and the supplement ingredient and drain through the bottom wall of the housing.

8. A method of preparing a supplemented brewed beverage using a beverage cartridge, the method comprising:

discharging hot water into a housing of the beverage cartridge, the housing including a sidewall with an inwardly projecting shoulder and a bottom wall;

intermixing the hot water with a beverage ingredient contained within the cartridge to create a brewed beverage;

filtering the brewed beverage with a filter extending across an interior of the beverage cartridge to create a filtered brewed beverage, the filter secured to a generally rigid basket with an outwardly projecting flange resting on the inwardly projecting shoulder of the housing; and intermixing the filtered brewed beverage with a supplement ingredient disposed in a lower portion of the beverage cartridge spaced from the filter to create a supplemented brewed beverage.

9. The method of claim 8, further comprising dispensing the supplemented brewed beverage through an opening in a bottom wall of the beverage cartridge.

10. The method of claim 8, further comprising puncturing a cover of the beverage cartridge with a hollow utensil, wherein discharging the hot water into the beverage cartridge comprising discharging the hot water through the hollow utensil.

11. The method of claim 8, wherein intermixing the hot water with a beverage ingredient comprises intermixing the hot water with ground coffee.

12. The method of claim 8, wherein intermixing the filtered brewed beverage with the supplement ingredient comprises melting the supplement ingredient with the filtered brewed beverage.

13. The method of claim 8, wherein intermixing the filtered brewed beverage with the supplement ingredient comprises intermixing the filtered brewed beverage with clarified butter.

14. The method of claim 8, wherein intermixing the filtered brewed beverage with the supplement ingredient comprises intermixing the filtered brewed beverage with one or more of: butter, coconut oil, avocado oil, medium chain triglyceride (MCT) oil, tetrahydrocannabinol (THC), cannabidiol (CBD), sugar, spices, or herbs.

15. A method of assembling a beverage cartridge, the method comprising:

depositing a supplement ingredient in a lower portion of a housing of the beverage cartridge, the housing including a sidewall with an inwardly projecting shoulder and a bottom wall;

disposing a filter assembly comprising a generally rigid basket with an outwardly projecting flange and a filter secured to the basket into the interior of the housing so that the outwardly projecting flange of the basket rests on the inwardly projecting shoulder of the housing;

depositing a predetermined amount of beverage ingredient into the filter assembly;

sealing an open top of the housing with a cover.

16. The method of claim 15, wherein depositing the supplement ingredient in the lower portion of the housing comprises depositing one or more of: clarified butter, butter, coconut oil, avocado oil, medium chain triglyceride (MCT) oil, tetrahydrocannabinol (THC), cannabidiol (CBD), sugar, spices, or herbs, in the lower portion of the housing.

17. The method of claim 15, wherein depositing the predetermined amount of beverage ingredient into the filter assembly comprises depositing a predetermined amount of ground coffee into the filter assembly.

18. The method of claim 15, wherein the filter assembly is sized so that with the flange abutting the shoulder, the lower portion of the housing corresponds to an open lower portion extending between a bottom surface of the filter assembly and a bottom wall of the housing.

* * * * *